US008967785B2

(12) United States Patent
Veis et al.

(10) Patent No.: US 8,967,785 B2
(45) Date of Patent: Mar. 3, 2015

(54) PREHEAT AT LEAST ONE OF MEDIA AND MEDIA SUPPORT MEMBER TO PREDETERMINED TEMPERATURE IN PREHEAT MODE

(75) Inventors: Alex Veis, Kadima (IL); Lior Lifshitz, Mevaseret Zion (IL); Alon Sarig, Netanya (IL); Gilhad Ben-Bassat, Kfar Yona (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 89 days.

(21) Appl. No.: 13/423,645

(22) Filed: Mar. 19, 2012

(65) Prior Publication Data

US 2013/0242014 A1 Sep. 19, 2013

(51) Int. Cl.
*B41J 2/01* (2006.01)

(52) U.S. Cl.
USPC ..... 347/102

(58) Field of Classification Search
CPC ..... B41J 2/01
USPC ..... 347/102
See application file for complete search history.

(56) References Cited

U.S. PATENT DOCUMENTS

| | | | | |
|---|---|---|---|---|
| 6,161,930 | A * | 12/2000 | Asano | 347/102 |
| 2002/0093543 | A1 * | 7/2002 | Sawano | 347/9 |
| 2003/0218647 | A1 * | 11/2003 | Ogawa | 347/16 |
| 2009/0309912 | A1 * | 12/2009 | Kusuhata | 347/16 |
| 2010/0177151 | A1 * | 7/2010 | Thompson et al. | 347/102 |
| 2011/0037802 | A1 * | 2/2011 | Brewington et al. | 347/16 |
| 2011/0128319 | A1 * | 6/2011 | Mitsuzawa | 347/16 |
| 2011/0267410 | A1 * | 11/2011 | Yamamoto et al. | 347/102 |
| 2012/0038724 | A1 * | 2/2012 | Sanada | 347/102 |

* cited by examiner

*Primary Examiner* — Alessandro Amari
*Assistant Examiner* — Alexander C Witkowski

(57) ABSTRACT

An image forming apparatus and printing methods include a media support member to support media and an ink applicator unit to selectively apply ink to the media disposed on the media support member in a print mode. The image forming apparatus and printing methods also include a heating unit to preheat at least one of the media support member and the media to a predetermined temperature in a preheat mode prior to the selective application of the ink to the media.

20 Claims, 5 Drawing Sheets

PREHEAT AT LEAST ONE OF MEDIA AND MEDIA SUPPORT MEMBER TO PREDETERMINED TEMPERATURE IN PREHEAT MODE

BACKGROUND

Image forming apparatuses include ink applicator units to selectively apply ink on media to form images. The ink applicator units may include a plurality of inkjet printheads. The ink may include ultraviolet curable ink.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components, layers, substrates and features illustrated in the figures are chosen primarily for convenience and clarity of presentation and are not necessarily to scale. Referring to the attached figures:

DETAILED DESCRIPTION

Image forming apparatuses include ink applicator units to selectively apply ink on media to form images. The ink may include ultraviolet (UV) curable ink. The ink applicator units may include a plurality of inkjet printheads, for example, to eject the UV curable ink in the form of drops onto the media. Curing units may cure the UV curable ink applied to the media. However, heat may be emitted by the curing unit and, for example, cause thermal expansion of respective media to be printed on during printing cycles. For example, the media may expand as it is being printed on. Further, media and a media support member holding the media in place thereon may expand at different rates. Thus, during a respective printing cycle, the drops of ink ejected by the inkjet printheads may not arrive at the intended locations on the respective media. That is, drop placement error and misalignment may occur. Consequently, degradation of the image quality may result.

In examples, an image forming apparatus includes, among other things, a media support member, an ink applicator unit, and a heating unit. The media support member may support media. The ink applicator unit may selectively apply ink to the media disposed on the media support member in a print mode. The heating unit may preheat at least one of the media support member and the media to a predetermined temperature in a preheat mode prior to the selective application of the ink to the media. For example, the media may be preheated to a predetermined temperature for the media to reach a thermal equilibrium prior to receiving ink from the ink applicator unit. Thus, media expansion during printing thereon and drop placement error may be reduced. Consequently, degradation of the image quality may be reduced.

Figure 1:
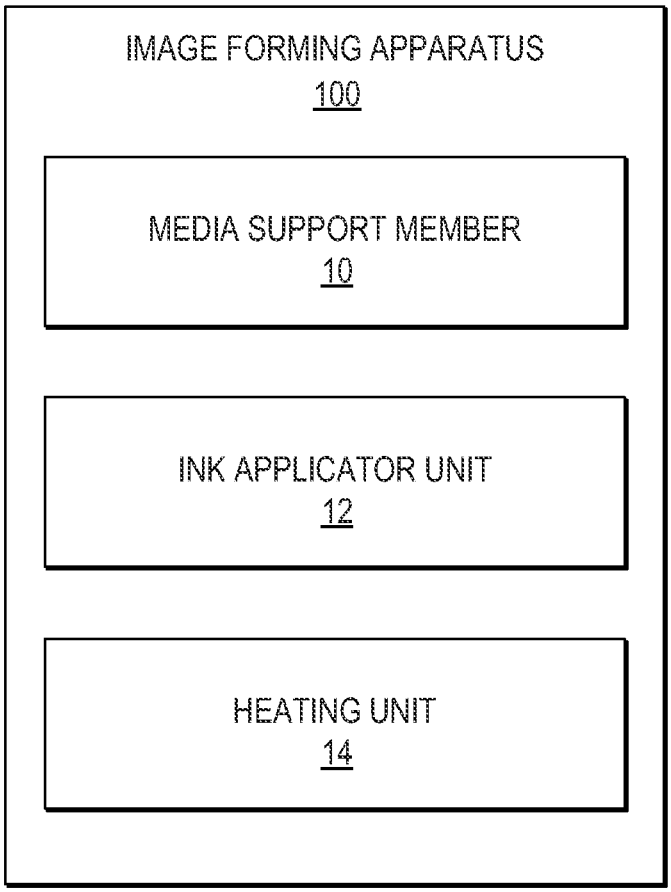
FIG. 1 is a block diagram illustrating an image forming apparatus according to an example.

FIG. 1 is a block diagram illustrating an image forming apparatus according to an example. Referring to FIG. 1, in some examples, an image forming apparatus 100 includes a media support member 10, an ink applicator unit 12, and a heating unit 14. The media support member 10 may support media m. For example the media support member 10 may be a bed, platen, and the like. In some examples, the media support member 10 may move with respect to the ink applicator unit 12 and/or the heating unit 14. That is, the media support member 10 may move with the media disposed thereon, while the ink applicator unit 12 and the heating unit 14 may be stationary. Alternatively, the ink applicator unit 12 and the heating unit 14 may move, while the media support member 10 is stationary. Additionally, both the media support member 10 and the set of the ink applicator unit 12 and the heating unit 14 may move with respect to each other.

Referring to FIG. 1, in some examples, the ink applicator unit 12 may selectively apply ink to the media disposed on the media support member 10 in a print mode. The print mode may be a mode in which ink is selectively applied to the media from the ink applicator unit 12 to form images thereon. For example, the media (FIG. 3) may be supported on a media support member 10 and transported to a print zone to receive ink from the ink applicator unit 12. In some examples, a vacuum unit 27 (FIGS. 2 and 3) may use negative pressure such as suction to hold the media against the media support member 10. In some examples, the ink applicator unit 12 may include a plurality of inkjet printheads 12*a*, 12*b*, 12*c*, 12*d*, 12*e*, 12*f*, 12*g*, and 12*h* (FIG. 2) having a variety of colored ink to form color images on the media m. For example, the colored ink may include cyan, magenta, yellow, black, white, and the like. The ink may include UV curable ink, and the like.

Referring to FIG. 1, in some examples, the heating unit 14 may preheat at least one of the media support member 10 and the media to a predetermined temperature $t_p$ in a preheat mode prior to the selective application of the ink to the media m. For example, the heating unit 14 may preheat the media m. In some examples, the heating unit 14 may heat the media and the media support member 10. The preheat mode may be a mode in which the respective media is preheated to a predetermined temperature $t_p$ prior to ink being applied thereto. In some examples, preheating at the predetermined temperature $t_p$ may cause the media to substantially complete its expansion and reach a thermal equilibrium prior to the media receiving ink thereon. The heating unit 14 may include a UV lamp, an infrared (IR) source, or use heat extracted by a UV cooling unit, and the like.

Figure 2:
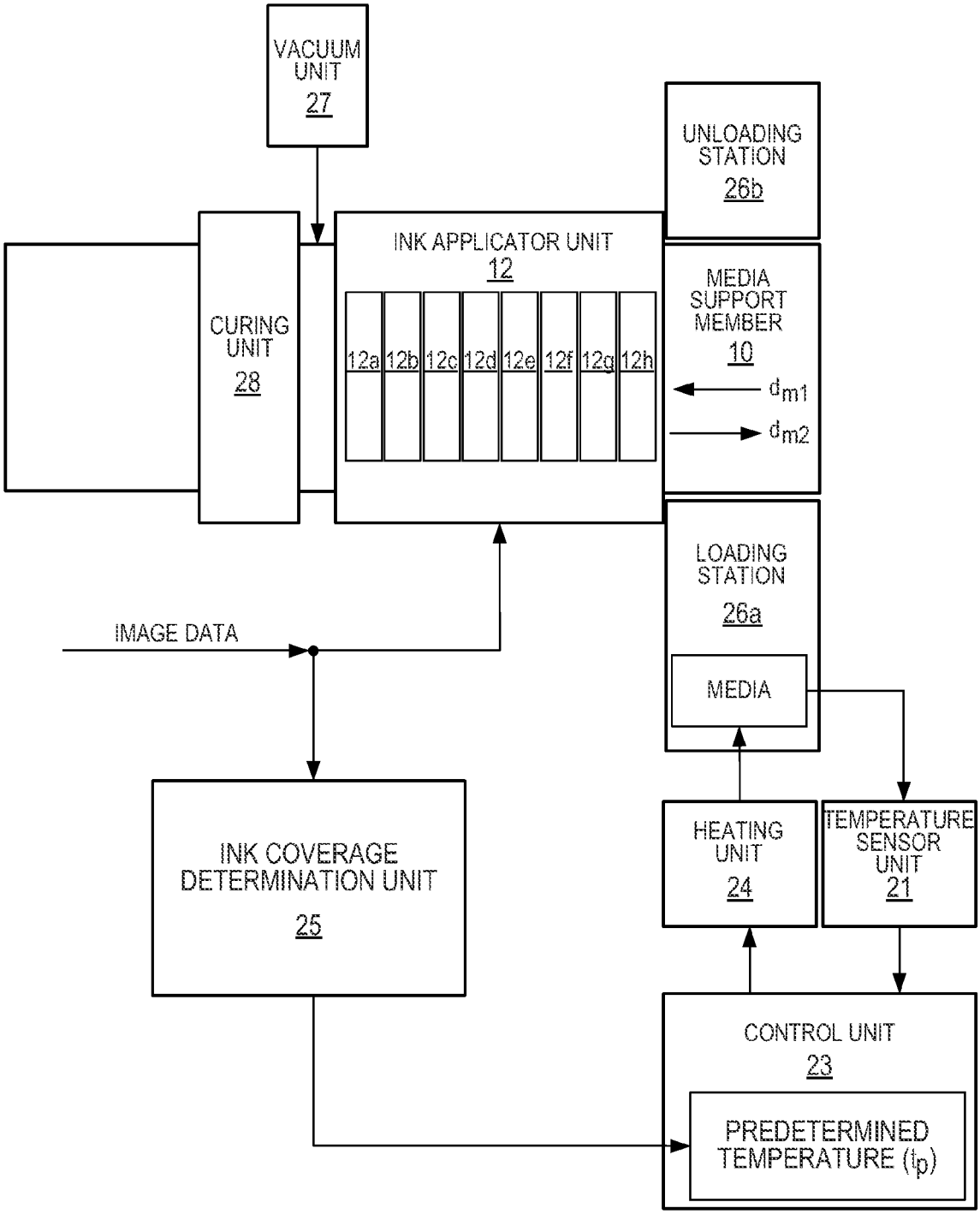
FIG. 2 is a schematic view of an image forming apparatus according to an example.

FIG. 2 is a schematic view of an image forming apparatus according to an example. Referring to FIG. 2, in some examples, the image forming apparatus 200 includes a media support member 10 and an ink applicator unit 12 as previously disclosed with respect to FIG. 1. Referring to FIG. 2, in some examples, the image forming apparatus 200 may also include a heating unit 24, a loading station 26*a*, a curing unit 28, an unloading station 26*b*, an ink coverage determination unit 25, a temperature sensor unit 21, a control unit 23, and a vacuum unit 27. The heating unit 24 may preheat at least one of the media support member 10 and the media to a predetermined temperature $t_p$ in a preheat mode prior to the selective application of the ink to the media m. In some examples, the heating unit 24 may include a UV lamp, an infrared (IR) source, or use heat extracted by a UV cooling unit, and the like.

Referring to FIG. 2, in some examples, the loading station 26*a* may store the media to be provided to the media support member 10. In some examples, the heating unit 24 may be configured to heat the media to the predetermined temperature $t_p$ while stored on the loading station 26*a*. The curing unit 28 may cure the ink applied to the media by the ink applicator unit 12 in a cure mode. For example, the curing unit 28 may be a UV lamp. The cure mode may be a mode in which the ink applied to the media is cured. In some examples, the curing unit 28 may be disposed upstream from the ink applicator unit 12 in a first media transport direction $d_{m1}$. The first media transport direction $d_{m1}$ may correspond to the direction in which the media is transported to be printed on. The unloading station 26*b* may receive the media having the ink applied thereon cured by the curing unit 28 from the media support member 10. In some examples, a second media transport direction $d_{m2}$ may correspond to the direction in which the media is transported after the receiving and curing of ink thereon.

Referring to FIG. 2, in some examples, the ink coverage determination unit 25 may determine an amount of ink coverage to be applied to the media m. That is, ink coverage may be a percentage of a print side of media to be covered with ink. For example, the ink coverage determination unit 25 may analyze image data to be provided to the ink applicator unit 12 to form images on the media m. That is, the ink coverage can be calculated from the bit map file, separately for each separation, by counting pixels. In some examples, the ink coverage can also be calculated according to CIP3 (International Cooperation for Integration of Prepress, Press, and Postpress) standard that supports similar features for usage in offset presses. In some examples, the ink coverage determination unit 25 can be implemented in hardware, software including firmware, or combinations thereof. The firmware, for example, may be stored in memory and executed by a suitable instruction-execution system. If implemented in hardware, as in an alternative example, the ink coverage determination unit 25 can be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the ink coverage determination unit 25 can be implemented in a combination of software and data executed and stored under the control of a computing device.

The predetermined temperature $t_p$ may correspond to the amount of ink coverage to be applied to the media determined by the ink coverage determination unit 25. For example, the predetermined temperature $t_p$ may include a temperature value equal to a sum of an ambient temperature $t_a$ and an ink coverage temperature value $t_i$. The ink coverage temperature value $t_i$ may be a temperature value corresponding to the respective amount of ink coverage of the media determined by the ink coverage determination unit 25. For example, the greater the amount of ink coverage of the media, the greater the value of the ink coverage temperature value. In some examples, the ink coverage temperature value may be in a range from four to ten degrees Celsius. The ambient temperature $t_a$ may correspond to the temperature proximate to and/or surrounding the image forming apparatus 200.

Referring to FIG. 2, in some examples, the temperature sensor unit 21 may detect a temperature of at least one of the media and the media support member 10. The temperature sensor unit 21 may include infrared contact free sensors, and the like. The control unit 23 may control the heating unit 24 based on the temperature detected by temperature sensor unit 21. In some examples, the temperature sensor unit 21 and control unit 23 can be implemented in hardware, software including firmware, or combinations thereof. The firmware, for example, may be stored in memory and executed by a suitable instruction-execution system. If implemented in hardware, as in an alternative example, the temperature sensor unit 21 and control unit 23 can be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the temperature sensor unit 21 and control unit 23 can be implemented in a combination of software and data executed and stored under the control of a computing device.

In some examples, the control unit 23 may compare the predetermined temperature $t_p$ with the respective temperature of at least one of the media and the media support member 10 detected by the temperature sensor unit 21 to determine whether the respective detected temperature is substantially equal to the predetermined temperature $t_p$. If so, the control unit 23 may deactivate the heating unit 24 and/or maintain the heating unit 24 at a temperature such as the predetermined temperature $t_p$. If not, the control unit 23 may activate the heating unit 24 and/or adjust a temperature of the heating unit 24 to a temperature such as the predetermined temperature $t_p$. The vacuum unit 27 may apply pressure to hold the respective media to the media support member 10.

Figure 3:
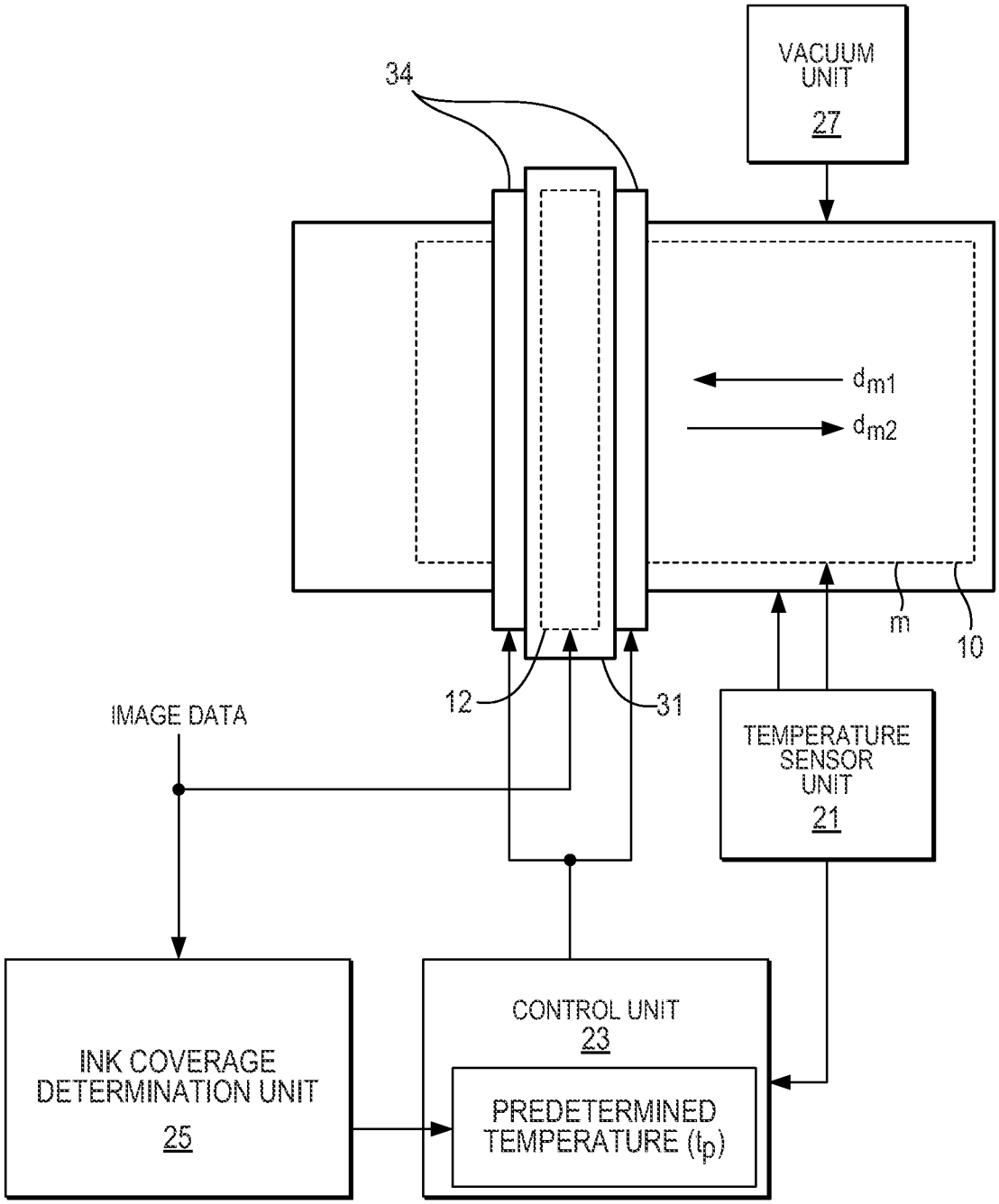
FIG. 3 is a schematic view of an image forming apparatus according to an example.

FIG. 3 is a schematic view of an image forming apparatus according to an example. Referring to FIG. 3, in some examples, an image forming apparatus 300 includes a media support member 10, an ink applicator unit 12, an ink coverage determination unit 25, a temperature sensor unit 21, a control unit 23, and a vacuum unit 27 as previously disclosed with respect to FIGS. 1 and 2. Referring to FIG. 3, in some examples, the image forming apparatus 300 may also include a heating unit 34 and a mounting member 31. The heating unit 34 may preheat at least one of the media support member 10 and the media to a predetermined temperature $t_p$ in a preheat mode prior to the selective application of the ink to the media m.

Referring to FIG. 3, in some examples, the heating unit 34 may include a UV lamp, and the like. For example, the heating unit 34 may include a first UV lamp disposed on an upstream side of the mounting member 31 and a second UV lamp disposed on a downstream side of the mounting member 31. For example, the upstream side of the mounting member 31 may be an outermost side of the mounting member in the first media transport direction $d_{m1}$ and the downstream side of the mounting member 31 may be an outermost side of the mounting member in the second media transport direction $d_{m2}$. The mounting member 31 may mount the heating unit 34 and the ink applicator unit 12 thereon. The mounting member 31 may pass the heating unit 34 and the ink applicator unit 12 across the media support member 10 to preheat the media and the media support member 10 in the preheating mode and to print on the media in the print mode. The heating unit 34 may also cure the ink applied to the media in the cure mode.

Additionally, in some examples, the media and the media support member 10 may be simultaneously heated by the heating unit 34. For example, the heating unit 34 may include a UV lamp to preheat the media and the media support member 10 in the preheat mode and to cure the ink applied to the media in a cure mode. The ink coverage determination unit 25 may determine an amount of ink coverage to be applied to the media m. In some examples, the predetermined temperature $t_p$ may correspond to the amount of ink coverage to be applied to the respective media determined by the ink coverage determination unit 25 as previously disclosed with respect to FIG. 2.

Figure 4:
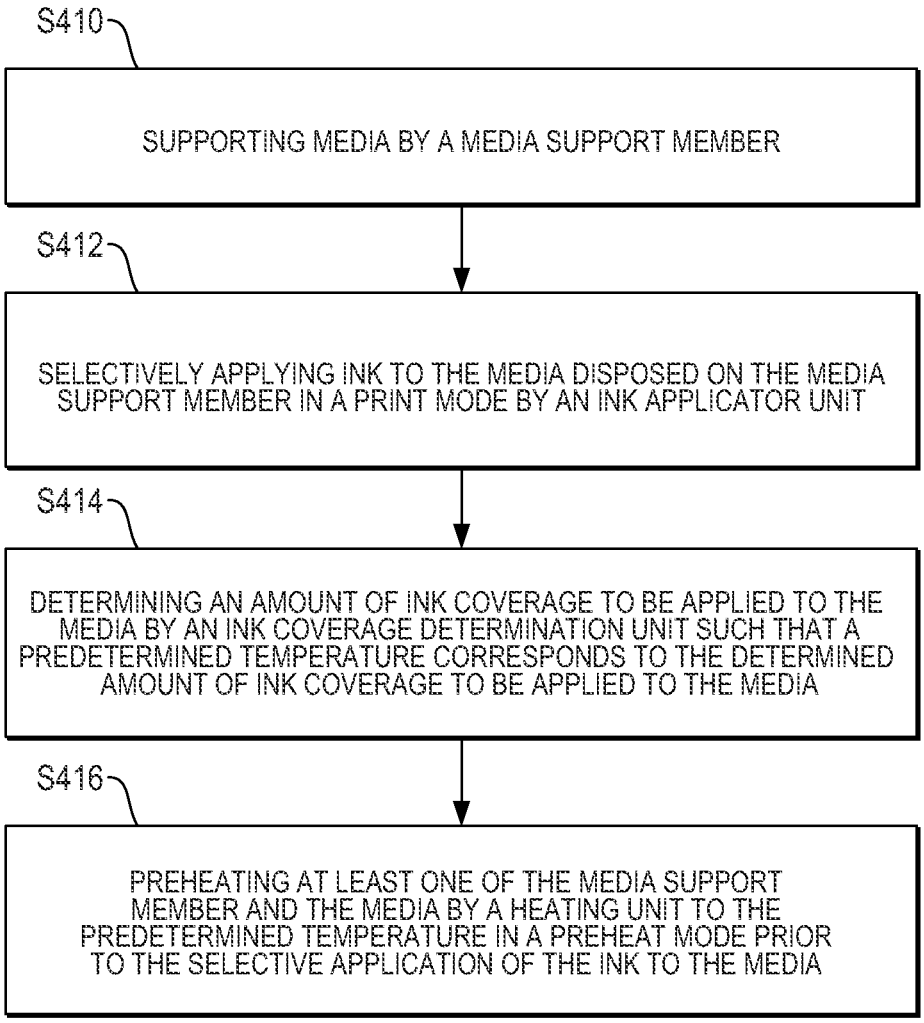
FIG. 4 is a flowchart illustrating a method of printing on media according to an example.

FIG. 4 is a flowchart illustrating a method of printing on media according to an example. Referring to FIG. 4, in block S410, a media support member supports media. In block S412, an ink applicator unit selectively applies ink to the media disposed on the media support member in a print mode by an ink applicator unit. In block S414, an ink coverage determination unit determines an amount of ink coverage to be applied to the media such that a predetermined temperature corresponds to the determined amount of ink coverage to be applied to the media. For example, the ink coverage determination unit may analyze image data to be provided to the ink applicator unit to form images on the media. In block S416, a heating unit preheats at least one of the media support member and the media to the predetermined temperature in a preheat mode prior to the selective application of the ink to the media.

In some examples, the method may also include a loading station storing the media to be provided to the media support member and the heating unit preheating the media to the predetermined temperature while stored on the loading station. The method may also include a curing unit curing the ink applied to the media by the ink applicator unit in a cure mode and an unloading station receiving the media having the ink applied thereon cured by the curing unit from the media support member. The method may also include a temperature sensor unit detecting a temperature of at least one of the media and the media support member and a control unit controlling the heating unit based on the temperature detected by the temperature sensor unit. The method may also include a vacuum unit applying pressure to hold the media to the media support member.

Figure 5:
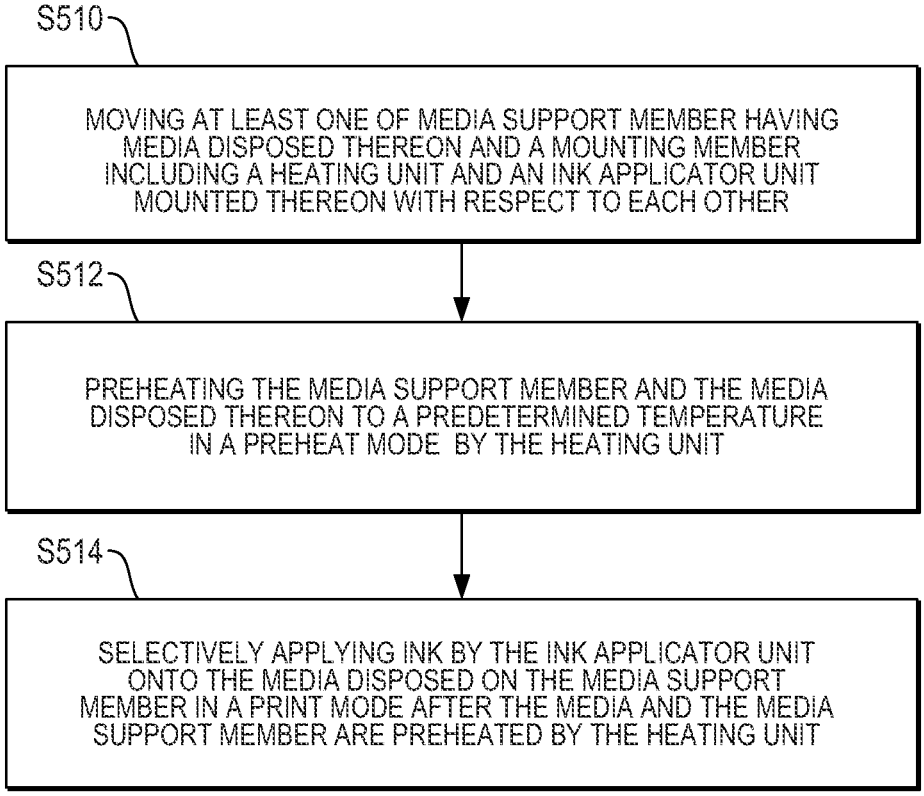
FIG. 5 is a flowchart illustrating a method of printing on media according to an example.

FIG. 5 is a flowchart illustrating a method of printing on media according to an example. Referring to FIG. 5, in block S510, at least one of a media support member having the media disposed thereon and a mounting member including a heating unit and an ink applicator unit mounted thereon move with respect to each other. For example, the media support member with the media disposed thereon may move and the mounting unit may be stationary. In some examples, the mounting unit may move and the media support member with the media disposed thereon may be stationary. In block S512, the heating unit preheats the media support member and the media disposed thereon to a predetermined temperature. For example, the heating unit may simultaneously preheat the media and the media support member. In some examples, the heating unit may include a UV lamp. In block S514, the ink applicator unit may selectively apply ink onto the media disposed on the media support member after the media and the media support member are preheated by the heating unit.

In some examples, the method may also include a temperature sensor unit detecting a temperature of at least one of the media and the media support member and a control unit selectively controlling the heating unit in response to the temperature detected by the temperature sensor unit. The method may also include a vacuum unit applying pressure to selectively hold the media to the media support member by a vacuum unit.

It is to be understood that the flowcharts of FIGS. 4 and 5 illustrate architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 4 and 5 illustrate a specific order of execution, the order of execution may differ from that which is depicted. For example, the order of execution of two or more blocks may be scrambled relative to the order illustrated. Also, two or more blocks illustrated in succession in FIGS. 4 and 5 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming apparatus, comprising:

a media support member to support media;

an ink applicator unit to selectively apply ink to the media disposed on the media support member in a print mode;

a heating unit to preheat at least one of the media support member and the media to a predetermined temperature in a preheat mode prior to the selective application of the ink to the media; and an ink coverage determination unit to determine an amount of ink coverage to be applied to the media by the ink applicator unit prior to the selective application of the ink to the media, wherein the predetermined temperature of the preheat mode corresponds to the amount of ink coverage to be applied to the media as predetermined by the ink coverage determination unit prior to the selective application of the ink to the media.

2. The image forming apparatus according to claim 1, further comprising:

a mounting member to mount the heating unit and the ink applicator unit thereon, the mounting member to pass the heating unit and the ink applicator unit across the media support member to preheat the media and the media support member in the preheat mode and to print on the media in the print mode.

3. The image forming apparatus according to claim 2, wherein the heating unit is an ultraviolet lamp to preheat the media and the media support member in the preheat mode and to cure the ink applied to the media in a cure mode.

4. The image forming apparatus according to claim 2, wherein the media and the media support member are simultaneously heated by the heating unit.

5. The image forming apparatus according to claim 2, wherein the heating unit comprises a first heating element disposed on an upstream side of the mounting member with respect to a media transport direction at a first side of the ink applicator unit and a second heating element disposed on a downstream side of the mounting member with respect to the media transport direction at a second side of the ink applicator unit.

6. The image forming apparatus according to claim 1, further comprising:

a loading station to store the media to be provided to the media support member; and wherein the heating unit is configured to heat the media to the predetermined temperature while stored on the loading station.

7. The image forming apparatus according to claim 6, further comprising:

a curing unit to cure the ink applied to the media by the ink applicator unit in a cure mode; and an unloading station to receive the media having the ink applied thereon cured by the curing unit from the media support member.

8. The image forming apparatus according to claim 1, further comprising:

a temperature sensor unit to detect a temperature of at least one of the media and the media support member; and a control unit to control the heating unit based on the temperature detected by the temperature sensor unit.

9. The image forming apparatus according to claim 1, wherein the media is moved with respect to the ink applicator unit and the heating unit.

10. A method of printing on media, the method comprising:

supporting the media by a media support member;

selectively applying ink to the media disposed on the media support member in a print mode by an ink applicator unit;

determining an amount of ink coverage to be applied to the media by an ink coverage determination unit prior to the selective application of the ink to the media such that a predetermined temperature of a preheat mode of a heating unit prior to the selective application of the ink to the media corresponds to the amount of ink coverage to be applied to the media as predetermined by the ink coverage determination unit prior to the selective application of the ink to the media; and preheating at least one of the media support member and the media by the heating unit to the predetermined temperature in the preheat mode prior to the selective application of the ink to the media.

11. The method according to claim 10, further comprising:

storing the media to be provided to the media support member by a loading station; and preheating the media to the predetermined temperature while stored on the loading station.

12. The method according to claim 10, further comprising:

curing the ink applied to the media by the ink applicator unit in a cure mode by a curing unit; and receiving the media having the ink applied thereon cured by the curing unit from the media support member by an unloading station.

13. The method according to claim 10, further comprising:

detecting a temperature of at least one of the media and the media support member by a temperature sensor unit; and controlling the heating unit based on the temperature detected by the temperature sensor unit by a control unit.

14. The method according to claim 13, wherein the ink applicator unit and the heating unit are mounted on a mounting member; and wherein the heating unit comprises a first heating element disposed on an upstream side of the mounting member with respect to a media transport direction at a first side of the ink applicator unit and a second heating element disposed on a downstream side of the mounting member with respect to the media transport direction at a second side of the ink applicator unit.

15. A method of printing on media, comprising:

moving at least one of a media support member having the media disposed thereon and a mounting member including a heating unit and an ink applicator unit mounted thereon with respect to each other, the heating unit including a first heating element disposed on an upstream side of the mounting member with respect to a media transport direction at a first side of the ink applicator unit and a second heating element disposed on a downstream side of the mounting member with respect to the media transport direction at a second side of the ink applicator unit;

preheating the media support member and the media disposed thereon to a predetermined temperature in a preheat mode by the heating unit; and selectively applying ink by the ink applicator unit onto the media disposed on the media support member in a print mode after the media and the media support member are preheated by the heating unit, wherein the predetermined temperature of the preheat mode corresponds to an amount of ink coverage to be applied to the media as predetermined by an ink coverage determination unit prior to the selective application of the ink to the media.

16. The method according to 15, wherein the moving at least one of a media support member having the media disposed thereon and a mounting member including a heating unit and an ink applicator unit with respect to each other further comprises:

moving the media support member with the media disposed thereon with respect to the mounting member.

17. The method according to claim 15, wherein the preheating the media support member and the media disposed thereon by the heating unit further comprises:

simultaneously preheating the media and the media support member by the heating unit.

18. The method according to claim 15, wherein the heating unit comprises a first ultraviolet lamp and a second ultraviolet lamp.

19. The method according to claim 15, further comprising:

detecting a temperature of at least one of the media and the media support member by a temperature sensor unit; and selectively controlling the heating unit in response to the temperature detected by the temperature sensor unit.

20. The method according to claim 15, wherein the moving at least one of a media support member having the media disposed thereon and a mounting member including a heating unit and an ink applicator unit with respect to each other further comprises:

moving the mounting member with the heating unit and the ink applicator unit mounted thereon with respect to the media support member with the media disposed thereon.

* * * * *